US009799978B2

(12) United States Patent
Duenkel et al.

(10) Patent No.: US 9,799,978 B2
(45) Date of Patent: Oct. 24, 2017

(54) SEAL-PRESERVING CONTACT ELEMENT WITH A POSITION SECURING ELEMENT

(71) Applicant: Tyco Electronics AMP GmbH, Bensheim (DE)

(72) Inventors: Dirk Duenkel, Bensheim (DE); Michael Schall, Sonderbach (DE); Gregor Panitz, Soergenloch (DE); Christian Schellhaas, Zwingenberg (DE); Volker Seipel, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 27 days.

(21) Appl. No.: 14/526,002

(22) Filed: Oct. 28, 2014

(65) Prior Publication Data

US 2015/0118919 A1 Apr. 30, 2015

(30) Foreign Application Priority Data

Oct. 30, 2013 (DE) ..... 10 2013 222 142

(51) Int. Cl.
*H01R 11/22* (2006.01)
*H01R 13/33* (2006.01)
(Continued)

(52) U.S. Cl.
CPC ..... *H01R 13/33* (2013.01); *H01R 13/08* (2013.01); *H01R 13/2407* (2013.01); *H01R 13/42* (2013.01); *H01R 13/2442* (2013.01)

(58) Field of Classification Search
CPC ..... H01R 13/113; H01R 13/111
(Continued)

(56) References Cited

U.S. PATENT DOCUMENTS 3,680,035 A 7/1972 Teagno et al.
4,357,066 A * 11/1982 Cairns ..... H01R 12/721 439/595
(Continued)

FOREIGN PATENT DOCUMENTS

DE 8608199 5/1986
DE 102011006226 10/2012
(Continued)

OTHER PUBLICATIONS

European Search Report issued by the European Patent Office, dated Mar. 26, 2015, for related European Patent Application No. EP 14189982.3; 8 pages.

*Primary Examiner* — Phuong Chi T Nguyen
(74) *Attorney, Agent, or Firm* — Faegre Baker Daniels

(57) ABSTRACT

The invention relates to a contact element, made of an electrically conductive contact material. In order to provide a contact element which can be passed repeatedly and non-destructively through a housing or a seal of a plug connector in and/or opposite to a direction of insertion (E), a contact element is provided comprising a body extending in the direction of insertion (E) and a position securing element disposed on an upper side of the body, projecting upwards out of an opening in the body transversely to the direction of insertion (E), and that can be deflected elastically, the position securing element having a slope surface that is inclined against the direction of insertion (E), adjoining which, without any kinks or edges, are a curved section and an end section, and the end section ending with a free end within the cubature of the body.

18 Claims, 2 Drawing Sheets

(51) Int. Cl.
*H01R 13/08* (2006.01)
*H01R 13/24* (2006.01)
*H01R 13/42* (2006.01)

(58) Field of Classification Search
USPC ..... 439/852, 851, 850, 849, 854, 862
See application file for complete search history.

(56) References Cited

U.S. PATENT DOCUMENTS 4,431,252 A * 2/1984 Cairns ..... H01R 23/70
439/595
7,462,079 B2 * 12/2008 Fabian ..... H01R 4/4818
439/438

FOREIGN PATENT DOCUMENTS

DE 102011089307 6/2013
WO WO 2012/130533 4/2012
WO WO 2013/09193 6/2013

* cited by examiner

SEAL-PRESERVING CONTACT ELEMENT WITH A POSITION SECURING ELEMENT

The present application claims priority from German national application Application DE 10 2013 222 142.8 filed on Oct. 30, 2013; the subject matter of which is incorporated herein by reference.

BACKGROUND

The invention relates to a contact element, made of an electrically conductive contact material, to be passed repeatedly and non-destructively through a housing or a seal of a plug connector in and/or opposite to a direction of insertion.

Contact elements or contact pins which are used in sealed plug connectors or housings are generally passed through a seal and/or a housing when assembling the plug connector. If the plug connector is to be repaired, the contact elements are often pulled out of the plug connector again. For this purpose they must pass through the seal in the direction opposite to the direction of insertion. Damage to the seal or even to the housing of the plug connector often occurs here. In the course of maintenance or repair the entire seal and/or the housing must then be replaced, and this means additional cost and time.

SUMMARY

It is therefore the object of the invention to provide a contact element which can be passed repeatedly through a seal or a housing of a plug connector, both in a direction of insertion and in the direction opposite to the direction of insertion, without thereby damaging the seal and/or the housing, but nevertheless guaranteeing secure holding of the contact element within the plug connector.

According to the invention this object is achieved by a contact element, as specified above, comprising a body extending in the direction of insertion and a position securing element disposed on an upper side of the body, projecting upwards out of an opening in the body transversely to the direction of insertion, and that can be deflected elastically, the position securing element having a slope surface that is inclined against the direction of insertion, adjoining which, without any kinks or edges, are a curved section and an end section, and the end section ending with a free end within the cubature of the body.

The position securing element according to the invention can be used for engagement with a detent opening within the plug connector so that the contact element is secured against displacement in or opposite to the direction of insertion. The upper side of the position securing element projecting out of the opening does not have any kinks or edges, by means of which the contact element can be pushed through a seal both in the direction of insertion and in the direction opposite to the direction of insertion without the position securing element tearing or scratching the seal. Since the end section lies with its free end within the cubature of the body of the contact element, the free end of the position securing element may also not damage a seal when the contact element is passed through, as is the case with the normal detent tongues of conventional contact elements. The position securing element can be deflected elastically and so can move away from the seal or the housing when the contact element is passed through a seal or a housing so as to prevent damage to these elements or to itself.

The solution according to the invention can be further improved by different configurations, each of which is advantageous in its own right, and which can be combined with one another arbitrarily. These embodiments and the advantages associated with them will be discussed in the following.

In order to obtain a particularly compact element the position securing element may be disposed at least partially between side walls extending in the direction of insertion. This arrangement may additionally offer protection for the position securing element.

According to another advantageous configuration the position securing element may be at least partially passed through between the side walls. Operational reliability can thus be increased.

In order to obtain a compact and stable contact element the body can have a box-shaped cross-section at least in the region around the position securing element, the cross-section in the region of the position securing element being able to have an opening in one side, namely in the upper side. The position securing element can be disposed projecting through this opening.

According to another advantageous configuration the contact element can have at least one upwardly pointing guide surface lying in front of and/or behind the slope surface in the direction of insertion. The at least one guide surface can advantageously guide a seal, which slides along the contact element when the contact element is passed through such a seal, towards the slope surface or away from the latter.

In order to obtain a particularly compact contact element, the at least one guide surface can be formed from the surface of at least one reinforcement region which is shaped from at least two layers of the contact material. The guide surface can then be formed from the upper layer of the reinforcement region. The at least two layers of the reinforcement region can in particular be arranged parallel to and lying against one another.

In order to improve the guiding of a seal which slides along the upper side of the contact element, a base of the position securing element can be disposed beneath the at least one guide surface. The base of the position securing element can preferably be disposed here on the end of the position securing element lying opposite the free end.

According to another advantageous configuration the position securing element can be formed from at least one of the layers of a reinforcement region. The position securing element can be formed here in particular integrally with one of the layers of the reinforcement region. This type of contact element has a particularly compact and stable structure. The base of the position securing element, which forms a substantially fixed end of the position securing element, can lie in the reinforcement region here, by means of which the position securing element is held in a stable manner. Alternatively, the position securing element can also be formed separately and can be connected to the body of the contact element by appropriate connection techniques such as for example welding, soldering, injection or adhesive bonding.

In order to make it possible to pass a contact element according to the invention through a seal in a particularly satisfactory manner, a run-on slope inclined towards the inside of the body can adjoin the at least one guide surface at an end facing away from the position securing element in the direction of insertion. In particular if an opening in the seal is smaller than a diameter of the contact element the run-on slope can expand the seal to such an extent that the latter rests against one of the guide surfaces and can slide smoothly over the contact element.

In order to obtain a particularly compact contact element with a simple structure the run-on slope can be formed from at least one layer of the contact material forming a guide surface. The run-on slope can in particular be formed by bending around part of a layer towards an inner contact element.

According to another advantageous configuration the contact element can have at least one stiffening lip which extends from a position on the upper side towards an opposite inner wall of the body. The stiffening lip can improve the stability of the contact element. The stiffening lip can in particular be disposed between the side walls and perpendicular to the latter. Particularly good stability of the contact element is provided if the stiffening lip is supported against the side walls. In order to further improve the stability of the contact element the stiffening lip can also be supported against the opposite inner wall on the lower side of the contact element.

A stiffening lip that is particularly easy to produce can be obtained if the at least one stiffening lip is formed from a layer of a guide surface. The stiffening lip can be produced here in particular by bending a region of this layer.

A particularly compact contact element can be obtained if the at least one stiffening lip is formed from a layer of the guide surface facing the free end of the position securing element.

In order to obtain a secure seat of the position securing element on the contact element and to prevent undesired bending of the position securing element away from the contact element, the free end can extend beneath a guide surface which forms a stop for the position securing element. In order to obtain a compact contact element the free end can extend beneath the guide surface which forms the stiffening lip.

According to another advantageous configuration, the curved section can have a convex support region projecting against the direction of insertion. Since the support region projects against the direction of insertion it can effectively prevent the position of the contact element in a plug connector from displacing the contact element against the direction of insertion. Here the support region can in particular lie against an inside of a detent opening. Here the convex curve can ensure that if a maximum allowed force is exceeded, the position securing element deflects elastically into the opening of the body against the direction of insertion and the contact element can be released from the plug connector. Moreover, the convex curve allows the contact element to be guided non-destructively through a seal against the direction of insertion.

In order to support the support region on the contact element against the direction of insertion and thus achieve good securing of the contact element within the plug connector, the curved section can have a rear region inclined in the direction of the mounting slope between the convex support region and the free end.

In order to enable elastic deformability of the curved section when a maximum permissible force is exceeded against the direction of insertion, the curved section can have a second curve from the convex support region to the free end. If the contact element according to the invention is to be released from a plug connector and a force is exerted upon the contact element against the direction of insertion, for example by tension, the convex support region can bend elastically in the direction of insertion. The second curve provides elastic deformation so that the curved section can bend back into its initial position when the force is reduced. If the convex support region is bent somewhat in the direction of insertion, the rear region can be deformed elastically such that it forms a run-on slope running against the direction of insertion via which the edge of a detent opening can slide, the position securing element being deflected into the body and the contact element being able to be removed from the plug connector.

In order to guarantee a particularly secure seat of the free end within the cubature of the body, the free end can be made in the form of a tongue which overlaps a guide surface transversely to the direction of insertion. The tongue and the guide surface can run at least partially parallel to one another here. The guide surface can form a stop for the tongue. The tongue and the guide surface can ensure that the position securing element can not be deflected out of the body of the contact element and that a seal can not be damaged in this way.

In order to obtain a contact element with a particularly compact structure, the tongue can overlap the guide surface which forms the stiffening lip.

In particular, the curved section can form an S-shaped profile with the convex support region, the second curve and the tongue. The rear region can be formed here by the cross-over from the convex support region to the second curve.

In order to further improve the passage through a seal or a housing, the at least one position securing element can be plunged at least partially into the body in at least one deflected passing through position.

In order to preserve a seal when inserting a tip of the contact element, at least one side wall can be bent towards the inside of the contact element in a tip region. A tip that is at least partially rounded in the direction of insertion is thus produced.

In order to obtain a contact element that is particularly quick and inexpensive to produce, at least the body and the position securing element can be shaped as a monolithic bent stamped part.

According to another advantageous configuration the entire contact element can be shaped as a monolithic bent stamped part.

In order to use the contact element for the contacting of a printed circuit board, the contact element can have a contact arm that can be deflected elastically transversely to the direction of insertion and which can be deflected by a counter-element that can be displaced in the direction of insertion.

In the following the invention is described in more detail with reference to the drawings using one embodiment as an example. The feature combinations in the exemplary embodiment shown as an example can be supplemented by further features according to the properties of the contact element according to the invention required for a specific application in accordance with the above comments. Also in accordance with the above comments, individual features of the embodiment described may also be omitted if the effect of this feature is irrelevant in a specific application.

The same reference numbers are always used in the drawings for elements with the same function and/or the same structure.

DETAILED DESCRIPTION

Figure 1:
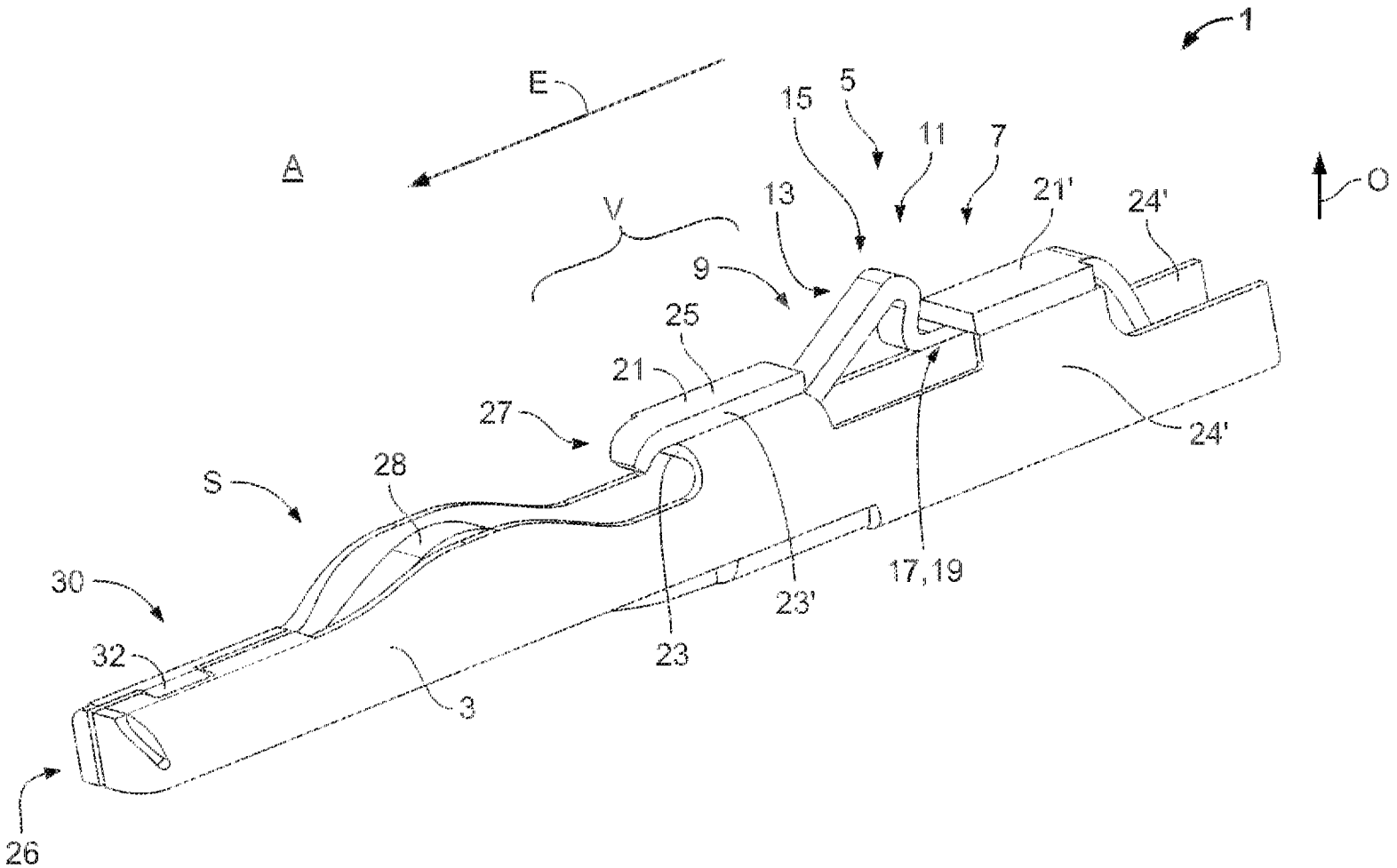
FIG. 1 an embodiment of a contact element according to the invention in a diagrammatic illustration.

First of all the structure of a contact element according to the invention is described with reference to FIGS. 1 to 3. FIG. 1 shows a contact element 1 according to the invention. The contact element 1 is made from an electrically conductive material 3. The contact element 1 is produced from the contact material 3 as a monolithic bent stamped part. The body 5 of the contact element 1 extends longitudinally along the direction of insertion E. The body 5 has the opening 9 on an upper side 7.

The directional designation "upwards" used in the following relates to the direction in which the upper side 7 points away from the contact element 1 and is marked by "O" in FIG. 1.

The elastically deflectable position securing element 11 projects upwards from the opening 9 of the body 5 at least in the initial position A. The position securing element 11 has a slope surface 13 inclined against the direction of insertion E. The slope surface 13 has no kinks or edges and does not have any sharp edges. A curved section 15, which likewise has no kinks or edges, adjoins the slope surface 13. The end section 17 and the free end 19 adjoin the curved section 15 against the direction of insertion E. The free end 19 lies within the cubature of the body 5. The configuration of the position securing element 11, in particular the configuration of the curved section 15 and the end section 17, are described in detail with reference to FIGS. 2 and 3.

In the region around the position securing element 11 the body 5 is box-shaped and has a box-shaped cross-section (not shown). The contact element 1 has a guide surface 21 lying in front of the slope surface 13 and a guide surface 21' lying behind the slope surface 13 in the direction of insertion E. The guide surfaces 21, 21' extend parallel to the direction of insertion E and point upwards.

Lying in front of the slope surface 13 in the direction of insertion E the contact element 1 has a reinforcement region V. The reinforcement region V is formed from two layers 23, 23' of the contact material 3 lying parallel and lying against one another. The layers 23, 23' are respectively formed from the side walls 24, 24' and respectively extend towards the opposite side walls 24', 24. The upwardly pointing surface 25' of the layer 23' of the reinforcement region V lying at the top forms the guide surface 21. The run-on slope 27 adjoins the guide surface 21 in the direction of insertion E. The run-on slope 27 is inclined towards the inside of the body 5. The run-on slope 27 is formed integrally with the layer 23' of the reinforcement region V.

The side walls 24, 24' are bent towards one another at the tip 26 so that the tip 26 is rounded in the direction of insertion.

In order to connect the contact element 1 electrically to a printed circuit board (not shown here), a contact arm 28 that can be deflected elastically downwards extends between the side walls 24, 24' in the tip region S.

In order to protect the contact arm 28 against deflecting upwards, the side walls 24, 24' are bent towards one another in an upper protective section 30 and are engaged with one another by means of an undercut arrangement 32.

Figure 2:
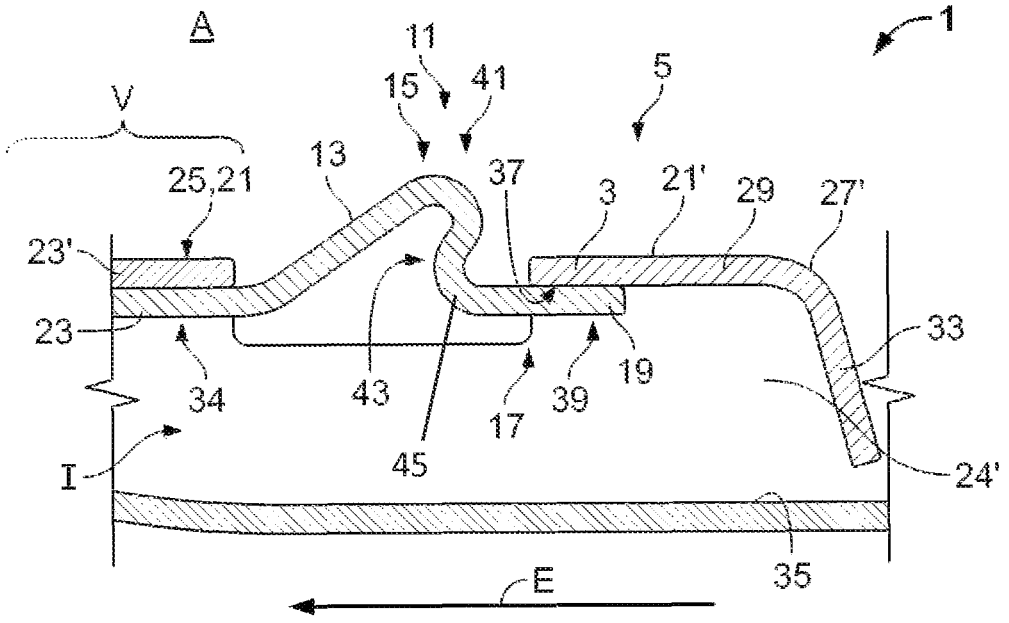
FIG. 2 a longitudinal section through the embodiment introduced in FIG. 1 in the region around a position securing element.

FIG. 2 shows a longitudinal section parallel to the direction of insertion E through the position securing element 11 shown in FIG. 1 in the initial position A perpendicular to the slope surface 13 and to the surfaces 25, 25'.

The position securing element 11 is disposed beneath the guide surface 25. It is formed integrally with the layer 23 of the reinforcement region V and extends from the latter against the direction of insertion E. In the direction of insertion E the base 34 lies opposite the free end 19 of the end section 17.

The guide surface 21' is located behind the slope surface 13 in the direction of insertion E. The stiffening lip 33 extends from the layer 29 the surface 31 of which forms the guide surface 21. The stiffening lip 33 extends towards the opposite inner wall 35. The stiffening lip 33 is disposed between the side walls 24 and 24' and supports the latter with respect to one another. The body 5 of the contact element 1 is thus advantageously stiffened. The stiffening lip 33 runs perpendicularly to the side walls 24, 24'. It can be configured continuously up to the inner wall 35. The stiffening lip 33 can be produced by bending around the layer 29 of contact material 3. The bending produces the run-on slope 27' which extends over the guide surface 21' and the stiffening lip 33.

The layer 29 from which the stiffening lip 33 extends forms a stop 37 for the free end 19 of the end section 17 of the position securing element 11. Therefore, the free end 19 lies beneath the guide surface 21. The free end 19 is configured as a tongue 39 and is substantially parallel to the direction of insertion E. The tongue 39 and the guide surface 21' overlap transversely to the direction of insertion E.

The curved section 15 of the position securing element 11 has a convex support region 41 that projects against the direction of insertion E. The rear region 43 runs between the support region 41 and the end section 17. In the rear region 43 the curved section 15 initially runs towards the slope surface 13. The second curve 45 adjoins the rear region 43. The second curve 45 constitutes a cross-over region between the rear region 43 and the end section 17 running parallel to the direction of insertion E. Overall, the end section 17, the second curve 45, the rear region 43, the support region 41 and the region of the position securing element 11 which forms the slope surface 13 form an S-shaped profile.

Figure 3:
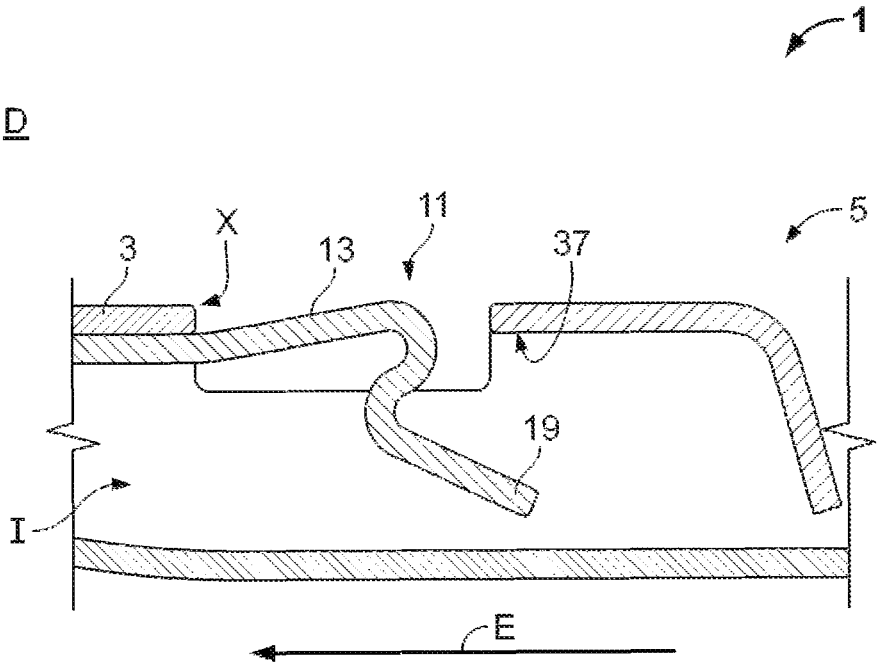
FIG. 3 a sectional illustration as in FIG. 2 with a position securing element in a deflected passing through position.

FIG. 3 shows the position securing element 11 from FIGS. 1 and 2 in a passing through position D. In the passing through position D the position securing element 11 is plunged into the body 5 of the contact element 1. The free end 19 is deflected away from the stop 37 into the interior I of the body 5. The position securing element 11 can be deflected because the contact material 3 from which the contact element 1 is produced has thin walls and is elastic. At the same time or alternatively, the region of the position securing element 11 which forms the slope surface 13 can be more elastic than the rest of the contact material 3. This can be achieved, for example, by at least part of the position securing element 11 having a smaller material thickness than the contact material 3 in the rest of the contact element 1.

In the following the function of a contact element 1 according to the invention will be described with reference to FIGS. 1 to 3:

Upon passing a contact element 1 through a seal along the direction of insertion E the tip region S with the tip 26 is first of all pushed through the seal. In this way the seal can already be expanded somewhat. The run-on slope 27 widens the seal to such an extent that the reinforcement region V can be pushed through and the seal slides over the guide surface 21 on the upper side 7. If the seal reaches the slope surface 13, it slides over the slope surface 13 and is thereby either expanded more or the position securing element 11 plunges somewhat into the body 5 of the contact element 1. As soon as the position securing element 11 has passed through the seal, the seal slides over the guide surface 21' and the run-on slope 27'. Therefore, the contact element 1 has passed through the seal in the direction of insertion E.

If the contact element 1 is inserted into a housing of a plug connector 5 in the direction of insertion E, this happens in substantially the same way as the passing through a seal. Since the housing is generally less elastic than a seal, the position securing element 11 is deflected into a passing through position D so that the contact element 1 can pass through the housing of the plug connector. If the contact element 1 is inserted into the plug connector to such an extent that a detent opening or some other detent element is disposed over the opening 9, the position securing element 11 is deflected back elastically into its initial position A. The support region 41 then lies against a wall of a detent opening or a detent element so that the contact element 1 cannot be moved against the direction of insertion E so long as a maximum force against the direction of insertion E is not exceeded.

If the contact element 1 is to be released again from the housing of the plug connector, tension is exerted upon the contact element 1 against the direction of insertion E. If the support region 41 lies against an inner wall of a detent opening or some other detent element, when the tensile force exceeds a maximum force, the curved section 15 deforms elastically in the direction of insertion E. The free end 19, which rests against the stop 37, thereby prevents the position securing element 11 from being bent out of the body 5. If the curved section 15 is deformed so strongly that the rear region 43 is inclined in the direction of insertion E, the position securing element 11 is deflected into the inside of the body 5 and adopts the passing through position D. In this way the contact element 1 can be released from the housing of the plug connector.

Upon passing through a seal in the direction opposite to the direction of insertion E, the seal can slide over the run-on slope 27' and the guide surface 21' to the position securing element 11. The seal can slide smoothly over the position securing element 11 because the support region 41 is convex in form and does not have any edges or kinks. The contact element 1 can therefore be released from a seal and a housing of a plug connector without damaging these elements or the contact element itself being damaged.

REFERENCE NUMBERS

1 contact element
2 contact material
5 body
7 upper side
9 opening
11 position securing element
13 slope surface
15 curved section
17 end section
10 free end
21, 21' guide surface
23, 23' layers
24, 24' side wall
25, 25' surface
26 tip
27, 27' run-on slope
28 contact arm
20 layer
30 upper protective section
31 surface
32 undercut arrangement
33 stiffening lip
34 base
45 inner wall
37 stop
39 tongue
41 support region
43 rear region
45 second curve
A initial position
D passing-through position
E direction of insertion
I inside of the body
O top
S tip region
V reinforcement region

The invention claimed is:

1. A contact element made of an electrically conductive contact material as a monolithic bent stamped part to be passed repeatedly and non-destructively through a housing and a seal of a plug connector in an insert mating direction, the contact element comprising:

a contact element body; the body comprising an insertion end portion, a reinforcing region portion, a position securing element and clamping end portion;

the insertion end portion forming as a stamp tube;

the reinforcing region portion extending from the stamp tube; the reinforcing region portion having two metal layers, the two layers overlapping directly one above another;

the position securing element forming by the one of the bottom layer extending upward in a first inclined angle toward the clamping end portion; and projecting upwards out of an opening forming on a terminal body as a deflected elastically first slope surface; the slope surface of the position securing element is continuing to bent downward in a second inclined angle toward the insertion end portion at the opening to form a second slope surface;

the second slope surface extending continuously in horizontal direction at the opening, along with the contact element body toward and abutting on an inner surface of the clamping end portion;

the clamping end portion lying on a free end of the position securing element; a free end of the clamping end extending downward in a downward direction, which is opposite to a first inclined angle direction of the first inclined angle to prevent over excessed inserting of a cable wire.

2. The contact element according to claim 1, wherein the curved section having a second curve from the convex support portion to the free end.

3. The contact element according to claim 1, wherein the at least one position securing element being plunged at least partially into the body, at least in a deflected passing through position (D).

4. The contact element according to claim 1, wherein at least the body and the position securing element being shaped as a monolithic bent stamped part.

5. The contact element according to claim 1, wherein the curved section includes a rear region inclined in a direction substantially parallel to the mounting slope between the convex support portion and the free end.

6. The contact element according to claim 1, wherein the free end is positioned within the cubature of the body in an initial position and in a pass through position.

7. The contact element according to claim 1, wherein an apex of the convex support portion projecting in the direction opposite to the direction of insertion (E).

8. The contact element according to claim 1, wherein the position securing element is capable of being moved into the cubature such that an upper surface of the convex support portion is one of even with or below an upwardly pointing guide surface.

9. The contact element according to claim 1, wherein the contact element having at least one stiffening lip which extends from a layer on the upper side towards an opposite inner wall of the body.

10. The contact element according to claim 9, wherein the at least one stiffening lip being formed from at least one layer of a guide surface.

11. The contact element according to claim 1, wherein the contact element having at least one upwardly pointing guide surface lying in front of and/or behind the slope surface in the direction of insertion (E).

12. The contact element according to claim 11, wherein a base of the position securing element being disposed beneath the at least one guide surface.

13. The contact element according to claim 11, wherein the free end extending beneath a guide surface which forms a stop for the position securing element.

14. The contact element according to claim 11, wherein the free end being made in the form of a tongue which overlaps a guide surface transversely to the direction of insertion (E).

15. The contact element according to claim 11, wherein the at least one guide surface being formed from the surface of at least one reinforcement region (V) which is shaped from at least two layers of the contact material.

16. The contact element according to claim 15, wherein the position securing element being formed from at least one of the layers of a reinforcement region (V).

17. The contact element according to claim 11, wherein at least one run-on slope inclined towards the inside (I) of the body adjoining the at least one guide surface at an end facing away from the position securing element in the direction of insertion (E).

18. The contact element according to claim 17, wherein at least one of the run-on slopes being formed from at least one layer of the contact material forming a guide surface.

* * * * *